United States Patent [19]

Schoendorfer

[11] 4,304,357

[45] Dec. 8, 1981

[54] BLOOD PROCESSING CENTRIFUGE

[75] Inventor: Donald W. Schoendorfer, Brookline, Mass.

[73] Assignee: Haemonetics Corporation, Braintree, Mass.

[21] Appl. No.: 159,932

[22] Filed: Jun. 16, 1980

[51] Int. Cl.[3] ..... B04B 11/00; B04B 15/00

[52] U.S. Cl. ..... 233/26; 233/23 A

[58] Field of Search ..... 233/23 A, 23 R, 27, 233/26, 1 A, 1 C, 1 R, 14 A, 14 R, 16, 19 R, 19 A, 20 R

[56] References Cited

U.S. PATENT DOCUMENTS

| | | | |
|---|---|---|---|
| 3,347,454 | 10/1967 | Bellamy | 233/14 R |
| 3,679,128 | 7/1972 | Unger | 233/27 |
| 3,987,961 | 10/1976 | Sinn | 233/20 R |
| 4,146,172 | 3/1979 | Cullis | 233/26 |

*Primary Examiner*—Robert W. Jenkins

*Attorney, Agent, or Firm*—Hamilton, Brook, Smith & Reynolds

[57] ABSTRACT

Apparatus is disclosed for centrifugally separating blood into a first blood component, such as a plasma-rich component, and a second blood component, such as a plasma-poor component. This apparatus employs a centrifuge intended to be used immediately adjacent to a blood donor. A flexible displacement pouch having a fluid operated diaphragm is positioned within a blood processing chamber of the centrifuge rotor. The blood processing chamber comprises a pair of contoured support shoes which structurally supports the displacement pouch and a flexible blood processing bag. Separated first blood component is expressed from the flexible blood bag by movement of the diaphragm and collected in a receiver container as the centrifuge rotor spins. A pressure plate is mounted against the support shoes. The plate has a mass sufficient to at least counterbalance the force exerted inwardly by the fluid in the blood processing bag during the separation process.

8 Claims, 2 Drawing Figures

BLOOD PROCESSING CENTRIFUGE

TECHNICAL FIELD

This invention is in the field of blood processing and more particularly relates to the separation of blood, including whole blood, into two or more components.

BACKGROUND ART

U.S. Pat. application Ser. No. 5126 to Allen Latham, Jr. filed Jan. 22, 1979 describes a centrifuge for separating one or more components of blood into precise fractions.

In the Latham centrifuge, a flexible, disposable blood processing bag is mounted in a contoured processing chamber consisting of a pair of support shoes within the centrifuge rotor. The contoured chamber is designed to support the blood bag in a position whereby separated blood components traverse a short distance in the process of separation. A flexible diaphragm or displacer bag is also positioned in the blood processing chamber of the rotor in a complementary relationship to the flexible disposable blood bag. The flexible diaphragm can be moved to apply pressure to the disposable blood bag in response to the introduction or expulsion, respectively, of a displacement fluid while the centrifuge rotor is either rotating or stationary. Additionally, displacer fluid can be expelled by pumping blood into the flexible, disposable blood processing bag.

The support shoes are held in a closed position by a support shoe holder having two side walls with curved lips which extend around the side edges of the shoes and are intended to maintain the shoes in a fixed side-by-side relationship with one another.

In practice, however, it has been found that a holder of the type shown in the Latham centrifuge would have to be fabricated from very heavy and expensive materials in order to withstand the vast pressures generated while processing blood as the centrifuge rotates.

For example, as previously mentioned, in one application it is desired to express one of the separated blood components from the blood bag into a centrally located collection chamber. The pressure required to do this is directly propositional to the length of tubing from the blood bag to the point of collection multiplied by the centrifugal force. Thus, for a 5.45 inch rotor radius and a centrifuge rotating at a speed of 2000 r.p.m. a pressure of 42 pounds per in.$^2$ is generated inside the blood processing bag.

This force, which amounts to in excess of 4000 pounds for a 10 in.$\times$10 in. bag, tends to push the two shoes apart.

One solution of this problem was to provide a rigid angle iron bracket adjacent the support shoes and affixed to the rotor wall. Long wedges were then driven into the gap between the angle iron brackets and the shoes. This solution made installation of the blood processing bag and displacer bag into the separation chamber shoes very cumbersome. Furthermore, stroboscopic observation of the support shoes during routine separation procedures revealed that the two shoes still were forced apart by about $\frac{1}{4}$ inch at the midpoint between the two wedges.

Accordingly, a need exists for a low cost apparatus and method for securing the separation chamber support shoes in a centrifuge which apparatus is easy to install and minimizes the stress on the support shoes.

DISCLOSURE OF INVENTION

The invention comprises an apparatus and process for separating blood into components thereof in a centrifuge. A pair of processing bags, one containing whole blood to be processed and one containing displacer fluid are disposed in contacting relationship within the contours of a pair of support shoes.

The support shoes are placed in the centrifuge rotor in an upright position adjacent the cylindrical outer wall of the rotor. A pressure plate is placed against the inner wall of the support shoe nearest the center of rotation of the rotor.

The mass of this pressure plate is critical. It must be specifically chosen to at least equalize the inner pressure generated by the processing bags. Since the radially inwardly directed force generated by the blood in the blood processing bag is proportional to the square of the rotor speed and the radially outward force generated by the pressure plate likewise varies as the square of the rotating speed, if the mass of the pressure plate is correctly chosen to at least equalize the inner pressure of the blood bag at, say, a rotor speed of one revolution per minute (r.p.m.), it will at least equalize at all rotor speeds. In application of the invention a pressure plate slightly greater in mass than that required to exactly equalize the pressure of the blood bag (say 2% greater) is used. This will guarantee closure of the shoes with practical variations in software mounting, etc.

It the mass of the pressure plate is greatly in excess of that required to balance or equalize the inner pressure generated by the blood bag under the influence of centrifugal force, then it is possible that the shoes, which are usually made of moderately rigid plastics, such as, foamed polyurethane, will collapse under the excess pressure exerted by the weight.

On the other hand, if the mass of the pressure plate is inadequate the shoes may be forced apart, in which case they will not be supporting the stresses associated with the bags and the bags may rupture.

BEST MODE FOR CARRYING OUT THE INVENTION

Inasmuch as a general description of the centrifuge blood separation process to which this invention relates is contained in the above referenced U.S. Pat. application Ser. No. 5126, it is not necessary to reiterate such details here, it being understood, however, that like terms shall have a like meaning and that the apparatus shown herein, although it is intended to be used in a similar application, is not hereby limited thereto.

Figure 1:
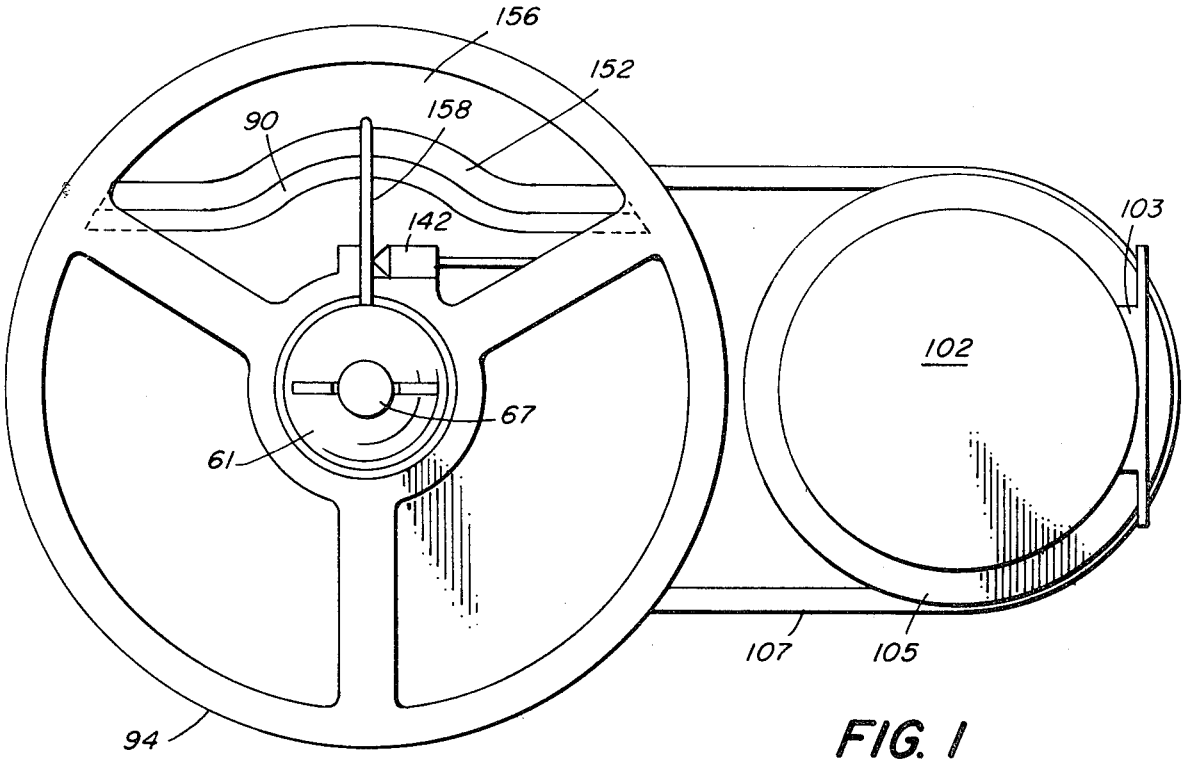
FIG. 1 is a plan view of a centrifuge in accordance with the invention.
Figure 2:
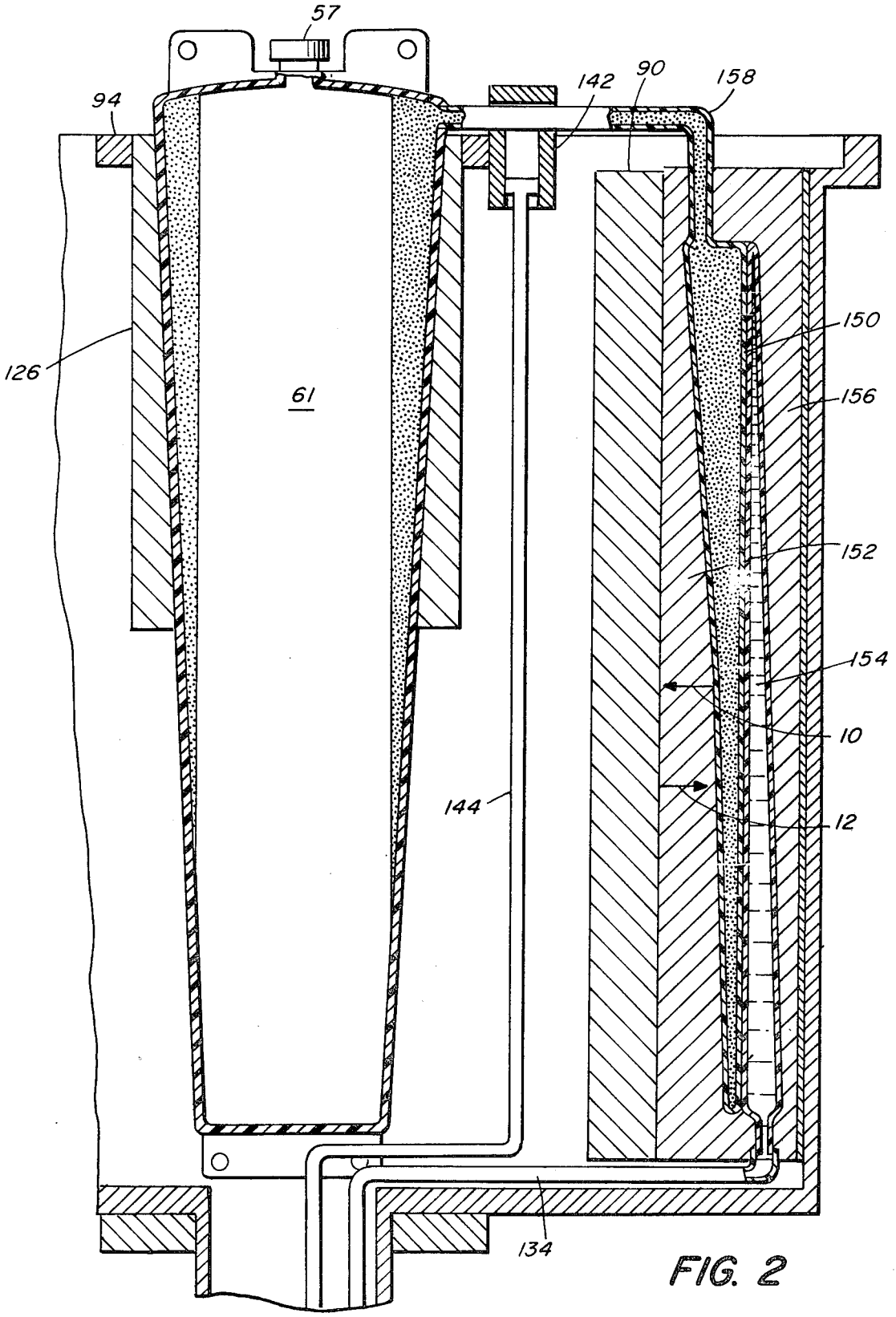
FIG. 2 is a partially cut-away side elevational view of the centrifuge rotor of FIG. 1.

Referring now to FIGS. 1 and 2, there is shown a blood processing bag 150 and a flexible displacement pouch 154, which are held in a complementary relationship in a contoured processing chamber formed between a pair of support shoes 152 and 156.

Support shoes 152 and 156 can be formed from polymers such as foamed polyurethane. In some cases, it will be preferred to have transparent support shoes, in which case they can be formed from transparent polymers, such as polymethyl methacrylate. Many other materials could be used in forming these support shoes, of course.

Displacer fluid pouch 154 is mounted on shoe 156 by inserting pegs (not shown) through registration holes in the peripheral seal of pouch 154. Processing bag 150 is similarly mounted on pegs on shoe 156. Shoes 156 and 152 are then closed together so that the pegs extend into matching holes in the edge of shoe 152. In their closed position, shoes 156 and 152 form an enclosed contoured processing chamber containing blood processing bag 150 and fluid displacer pouch 154, which are positioned so that their contacting planar panels assume a complementary relationship. Bag 150 is supported by contoured shoe 152 so that bag 150 has an inner surface having a slightly greater slope at its upper portion than at its lower portion. This increased slope provides more efficient emptying during operation. Displacer pouch 154 is contoured into a complementary shape by support shoe 156.

Tubing 158, at the top of bag 150, connects bag 150 to receiver container 61. When blood processing bag 150 and flexible pouch 154 are positioned in this complementary relationship within the contoured processing chamber formed between support shoes 156 and 152, pouch 154 serves as a displacement chamber having a fluid-actuated diaphragm. As displacer fluid is introduced into pouch 154, via conduit 134, it expands to force blood or blood components out of processing bag 150. Similarly, as anticoagulated whole blood passes into blood processing bag 150 under positive pressure, an equal volume of displacer fluid is forced from the flexible displacement pouch 154.

Pressure plate 90 is mounted adjacent shoe 152 on brackets (not shown). Pressure plate 90 has sufficient mass to exert an outward force (as shown by the arrow 12 in FIG. 2) which equalizes or is slightly greater than the force exerted inwardly (as shown by arrow 10 in FIG. 2) by the fluid in bag 150 when both are rotating at the same speed.

The mass of the plate 90, once correctly established for a given rotational velocity will balance the pressure from the bag at all velocities. This may be deduced from the following analysis:

For static conditions the force $F_p$ is exerted by the plate 90 acting radially outward under the influence of the centrifugal force should equal the force $F_s$ exerted on the innershoe 152 by the column of fluid (blood) in bag 150 which is ported via conduit 158 to the center of rotation of the rotor and thus exerts a radially inwardly directed force against shoe 152. In other words, $F_p$ should just equal $F_s$ to maintain equilibrium i.e., $$F_p = F_s \qquad \text{Equation I}$$

The pressure P in the bag 150 resulting from the rotating fluid (blood) is defined by the equation:

$$P = \tfrac{1}{2}\rho w^2 r_b^2 \qquad \text{Equation II}$$

where $\rho$ = density of fluid (blood)

$r_b$ = outside radius (radius of bag from the center of rotation)

w = rotational velocity in radius per second

The force $F_s$ exerted by the bag against the shoe is therefore:

$$F_s = P\,A \text{ or } \tfrac{1}{2}\rho w^2 r^2 A \qquad \text{Equation III}$$

where A = surface area of the blood bag

The force $F_p$ exerted by the plate against the shoe is equal to the mass of the plate M times the acceleration ($w^2 r_m$) where $r_m$ is the radius of the plate from the center of rotation or:

$$F_p = M w^2 r_m \qquad \text{Equation IV}$$

Substituting the equivalents in Equations III and IV for $F_p$ and $F_s$ in Equation I yields:

$$M w^2 r = \tfrac{1}{2}\rho w^2 {b}^2 A$$

or $$M = (\tfrac{1}{2}\rho r_b^2 A)/r_m \qquad \text{Equation V}$$

As can be realized from Equation V the value of m is independent of the rotational velocity of the centrifuge rotor. Also, given the values of $\rho$, $r_b$, $r_m$ and A, the mass of the plate M can be readily calculated.

In operation, the system works as follows:

Centrifuge motor 102 (FIG. 1) is activated to cause centrifuge rotor 94 to rotate at a speed sufficient to separate withdrawn whole blood contained in processing bag 150 into a plasma-rich component and a plasma-poor component. A typical rotor speed, for example, might be about 4800 r.p.m.

As centrifuge rotor 94 rotates, plasma-poor component, which in this case consists primarily of red blood cells, white blood cells and platelets, moves towards the radially outer face of disposable blood processing bag 150. This creates plasma-rich component near the radially inner face, and this can be expressed from disposable processing bag 150 as centrifuge rotor 94 spins by introducing displacer fluid into displacement pouch 154 thereby applying pressure to disposable blood processing bag 150.

Plasma-rich component is expressed through conduit 158 of the flexible blood processing bag 150 and is transported to receiver container 61 as rotor 94 continues spinning and further separation occurs.

During this process, the force exerted by the fluid in blood processing bag 150 radially inward is opposed by the outward force of pressure plate 90 which is free to slide against shoe 152 on guide rails not shown.

As can be seen, the pressure plate can be readily slid away from the shoes and then the shoes with processing bags easily removed or replaced without the use of cumbersome hardware. Thus an economical and reliable solution to the problem has been provided which is functional for all rotor speeds yet does not require massive structural supports since it is independent of rotor speed.

Those skilled in the art will recognize many equivalents to the specific embodiments described herein. Such equivalents are considered part of this invention and are intended to be covered by the following claims.

I claim:

1. Apparatus for processing fluids, comprising, in combination:

a. a centrifuge having a rotor capable of rotating about an axis of rotation at speeds sufficient to effect the desired separation;

b. a processing chamber mounted on said rotor comprising a pair of oppositely disposed supports contoured to support at least one flexible bag;

c. a flexible processing bag held within said supports;

d. a plate mounted adjacent said supports between the center of rotation of said rotor and the supports, said plate having a mass which during rotation of the rotor will create a radially outward force against the supports at least equal to the radially inward force exerted by fluid within said processing bag against the bag surface.

2. The apparatus of claim 1 wherein the supports consist of contoured foamed polyurethane shoes.

3. The apparatus of claim 1 in which the fluid is blood.

4. The apparatus of claim 1 including a displacer fluid bag adjacent said flexible bag.

5. The method of processing fluid into separate components comprising the steps of:

a. placing a first flexible bag containing fluid to be processed within the contoured walls of a pair of oppositely disposed support members;

b. mounting said members on a centrifuge rotor;

c. mounting a pressure plate opposite said support members in contact therewith and intermediate the center of rotation of the rotor and an inner wall of said support members, the mass of said plate being at least equal to the mass required during rotation, to counterbalance the inwardly directed force created within the bag by the outwardly directed force of the mass; and d. rotating said rotor.

6. The method of claim 5 including the steps of:

e. mounting a collection container at the center of rotation;

f. coupling the processing bag to the collection bag with flexible tubing;

g. disposing a second flexible bag adjacent said first flexible bag, said second flexible bag containing displacer fluid;

h. increasing the amount of displacer fluid in said second flexible bag to cause said bag to expand to thereby express blood components from said first flexible bag while said rotor is rotating.

7. The method of claim 5 in which the fluid is blood.

8. The method of claim 7 in which the members are mounted on the periphery of the rotor and the blood is separated into components.

* * * * *